US005333660A

United States Patent [19]

Kohlmann et al.

[11] Patent Number: 5,333,660

[45] Date of Patent: Aug. 2, 1994

[54] PURIFIED WATER DISPENSING APPARATUS AND METHOD

[76] Inventors: Michael J. Kohlmann, 5105 W. 58th St., Edina, Minn. 55436; Randall W. Williams, 5582 Oak Glen Rd., Edina, Minn. 55439

[21] Appl. No.: 849,189

[22] Filed: Mar. 11, 1992

[51] Int. Cl.[5] ..... B65B 3/00

[52] U.S. Cl. ..... 141/263; 141/266; 141/2; 141/18; 141/25; 138/30; 417/540; 222/1; 222/372; 222/92; 74/89.17

[58] Field of Search ..... 141/263, 266, 1, 2, 141/250, 251, 267, 269, 279, 284, 367, 368, 18, 21, 25, 159-161, 165, 177, 181, 182, 387, 388; 138/26, 30; 222/1, 92, 95, 105, 129.1, 129.4, 372, 386, 386.5, 389; 74/89.17; 192/56 R; 464/30, 47; 417/540

[56] References Cited

U.S. PATENT DOCUMENTS

| | | | |
|---|---|---|---|
| 2,208,028 | 7/1940 | Harrington | 141/263 |
| 2,474,512 | 6/1949 | Bechtold et al. | 138/30 |
| 2,810,496 | 10/1957 | Gray | 417/540 X |
| 2,898,954 | 8/1959 | Freeman | 141/263 X |
| 3,157,202 | 11/1964 | Sadler et al. | 138/26 |
| 3,601,164 | 8/1971 | Bruce | 141/284 X |
| 4,102,367 | 7/1978 | Shulman et al. | 141/387 X |
| 4,445,629 | 5/1984 | Doerfler | 138/30 |
| 4,586,546 | 5/1986 | Mezei et al. | 141/2 |
| 5,002,737 | 3/1991 | Tervamaki | 222/386 X |

*Primary Examiner*—J. Casimer Jacyna

[57] ABSTRACT

An improved apparatus and method for self-service dispensing of purified water with enhanced efficiency and safety. Personal injury and property damage caused by inadvertent impact of the movable dispensing spout is prevented by use of an adjustable slip clutch connected to the spout drive motor. Additionally, intermittent delivery of small quantities of purified water i.e. "topping off", is achieved without a motorized pump through manual tapping of an accumulator tank of variable storage capacity, containing a pressurized internal bladder. When emptied, the accumulator tank activates a motorized pump to provide for refilling the tank.

13 Claims, 5 Drawing Sheets

PURIFIED WATER DISPENSING APPARATUS AND METHOD

FIELD OF THE INVENTION

This invention relates to the field of self-service dispensing of purified water. More particularly, the invention discloses an apparatus and a method whereby consumers may dispense purified water into their own containers with safety and efficiency.. Means are provided for stopping the downward motion of a movable dispensing spout in order to reduce the risk of injury or damage which could be caused by such movement. Further means are provided for inhibiting short cycling of the pump when dispensing intermittently or at low flow rates to "top off" a container.

BACKGROUND OF THE INVENTION

A variety of devices have long been utilized to treat and dispense purified water. Such devices typically include a variety of filters, adsorption mediums and reverse osmosis membranes to remove organic and inorganic substances. Some also include ultraviolet light sources which are used to irradiate the treated water as another means of destroying microorganism that would contaminate the water. As purified water has become more widely used new apparatus and methods have been developed to purify and dispense it to a broader range of locations. One particular type of system allows municipal or approved potable well water to be purified and dispensed to grocery store customers and the like who fill a container at a stationary dispensing unit located on or about the store premises.

In some self service type dispensers, the dispenser spouts are often moveable up and down to accommodate a variety of container sizes having different heights that must fit beneath the spout. In the past it has been possible for the customer to be injured if they placed their fingers between the moving spout and the container mouth as the motor which drives the spout comes down to engage the container mouth to avoid spillage.

Customers will also often intermittently activate or adjust for low flow the control valve which controls the flow of water through the spout while "topping off" the fill of their container. This requires a constant cycling of the dispenser pump and requires the pump to cycle on and off while pumping water out of the spout at a low flow rate. Such dispensing usage has been known to cause undue wear and tear on the pump as it constantly starts up and shuts down. Dispenser inoperability may result if the pump fails and costly non-scheduled maintenance visits may result. This in turn will result in lost revenue and customer frustration until the normal maintenance intercession occurs.

SUMMARY OF THE PRESENT INVENTION

The present invention of an improved purified water dispensing apparatus and method remedies several design problems encountered in existing dispenser systems. which are intended to allow the customer to move the spout up and down to a position where the spout contacts the container fill opening. In existing dispenser designs such devices are prone to cause injury where the motor driven spout housing may catch a customer's finger between the spout housing and the container, or may cause damage to the container. In the present invention a slip clutch mechanism is utilized between the spout drive motor and the moveable spout to prevent undue force from being exerted by the moving spout. A second attribute of the improved water dispenser is improved spout movement apparatus and method for using it. Both apparatus and method prevent the spout from causing injury or damage is drawn by activation of the fill control valve. In existing designs where no such tank is used, the dispensing pump is activated each time a customer activates the control valve while he or she is "topping off" their container or requiring very low flow to their container. This causes undue wear and tear on the pump and more frequent pump break down. This is severely detrimental in remote self serve dispensing locations where normal maintenance checks are scheduled on a relatively infrequent basis. By using an accumulator tank with a variable capacity bladder, small amounts of water can be drawn from the accumulator tank through the fill spout to top off the container without the need to restart the Dump each time. This greatly reduces maintenance needs, avoids very costly shut downs of the dispenser and avoids non-scheduled service calls.

The present system may also include an elongated ultraviolet lamp at the dispensing spout with improved shrouding to prevent spout contamination, each of which feature is described in our copending application Ser. No.: 07/849,210 filed on even date herewith which is incorporated herein by reference.

BRIEF DESCRIPTION OF THE DRAWINGS

The invention is described in more detail hereinafter with reference to the accompanying drawings wherein like reference characters refer to the same parts throughout the several views, and in which.

DETAILED DESCRIPTION OF THE INVENTION

Figure 2:
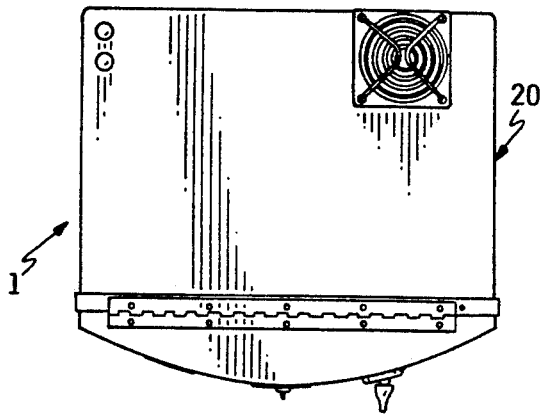
FIG. 2 is a top planform view of the dispensing cabinet shown in FIG. 1.
Figure 3:
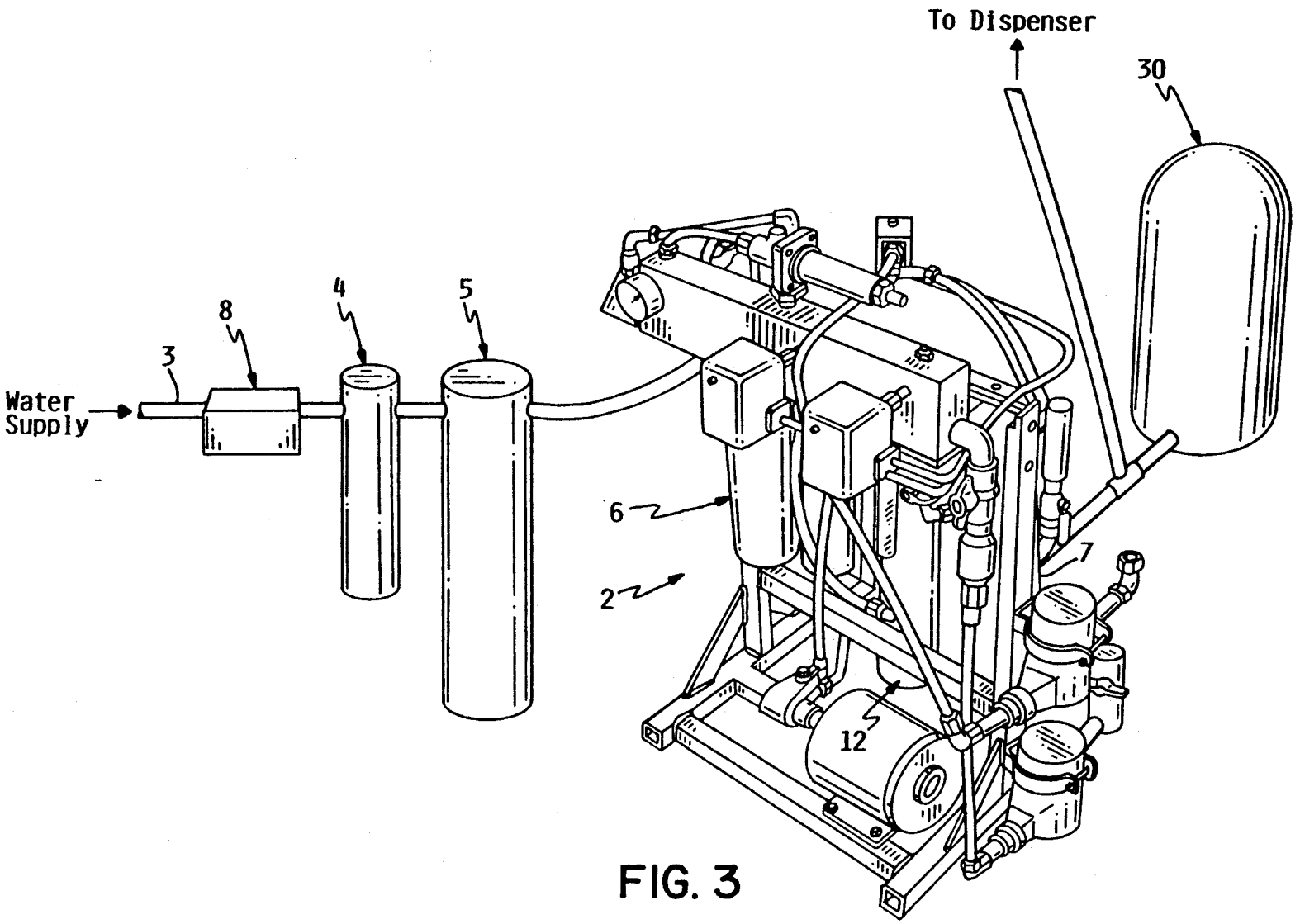
FIG. 3 is a perspective view of the water processing unit showing various components utilized to purify and pump water through a holding tank and to the dispensing cabinet shown in FIG. 1.

A preferred embodiment of the present invention is incorporated into a dispenser 1 (shown in FIGS. 1 and 2) used to dispense water which is pretreated in a processing unit 2 shown in FIG. 3. Therefore, to establish the technology in which the present invention finds application, a description of the processing unit and the general dispenser design will be first described.

Figure 4:
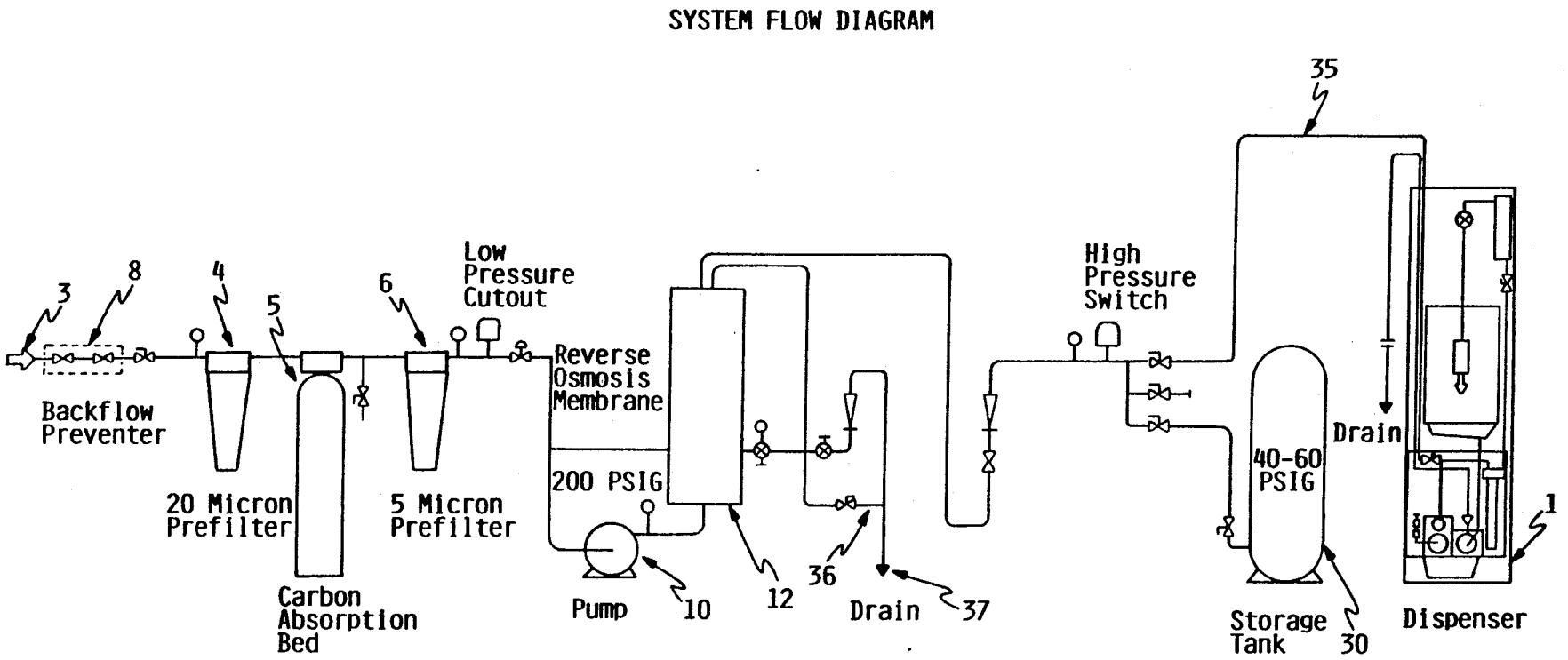
FIG. 4 is a schematic flow diagram showing the stages of water purification of the type which may utilize the present invention.

Processing unit 2 is intended to provide pretreated water having a predetermined level of purity. The following description of the composition of processing unit 2 shown in FIG. 3, and schematically in FIG. 4, is offered as a means of understanding the operation and use of dispenser 1 but other components and individual functions may also be used in processing unit 2 to practice the present invention. Typically processing unit 2 would be placed in a part of the store, such as a back room, where it is out of reach of customers and accessible to service personnel. The water which is pretreated by processing unit 2 would then be directed through tubing (not shown) to dispenser 1, and possibly to other areas needing pretreated water such as a produce misting area, a coffee maker or a drinking fountain.

Processing unit 2 utilizes water supply means to feed water into the processing unit from a municipal or approved potable well water supply line 3. Water is supplied through line 3 at a head pressure in the range of 10 to 100 pounds per square inch (psi). As is shown schematically in FIG. 4, from supply line 3 water flows through a first sediment filter 4 (shown in FIG. 3) which utilizes a twenty micron pleated filter (not shown in Figures) to remove sediment particles which are nominally twenty microns in diameter or larger. The water next flows through carbon adsorption filter bed 5, shown in FIG. 3 and schematically in FIG. 4, containing granular activated carbon to remove various organic contaminants in a manner well known in the filtering art. In the preferred embodiment carbon filter 5 contains approximately 16 pounds of activated carbon. The water then flows through carbon filter 6 which utilizes a five micron carbon filter to remove particles which are nominally five microns or larger in diameter. The specific designs of each of the forgoing filters may vary in accordance with well known water filtration and purification art. As is also well known in the plumbing art, a double check valve or backflow preventer, identified by the numeral 8 in FIGS. 3 and 4, is installed in supply line 3 to prevent any water that may be contaminated by the operations of processing unit 2 or dispenser 1 from being discharged upstream toward the municipal or well supply which may result from any unexpected pressure drop in supply line 3.

Water flows out of carbon filter 6 to a booster pump 10 which increases the head pressure of the water flow to approximately 200 psi. From booster pump 10 the water flows into a reverse osmosis membrane filter 12, shown schematically in FIG. 4. It is the purpose of booster pump 10 to maintain sufficient pressure in reverse osmosis filter 12 to accomplish reverse osmosis filtration in accordance with well known filter design art. While reverse osmosis filter 12 may have any variety of design as is well known in the art, in the preferred embodiment reverse osmosis filter 12 contains a spiral wound thin film composite semi permeable membrane. The general operation of reverse osmosis membrane filter 12 involves the forced flow of the water supply across the semi permeable membrane under a suitable pressure, varying in accordance with the specific membrane design. The semi permeable membrane can have various configurations, but, in general, the membrane is designed with a porosity which allows water molecules, having a known and finite size, to flow through the membrane, but which does not allow other elements, such as the molecules or ions of various dissolved solids and contaminants, to pass through the membrane. In a manner well known in the art it is necessary to continually flush the upstream side of the membrane with water to wash away the contaminants which are not able to cross the membrane. This flushing circuit, designated by the numeral 36, leads to a flush drain 37, each being shown schematically in FIG. 4 and having a construction of the type we. 1l known in the plumbing art.

The water supply which has been pretreated by processing unit 2 is stored in one or more storage tanks, each designated by the numeral 30 in FIGS. 3 and 4. Storage tank 30 is a bladder type design wherein a flexible membrane (not shown in the Figures) expands and contracts with air pressure on one side, and the water supply on the other, to allow the tank 30 to be filled and emptied without the pretreated water supply coming into contact with the outside contaminated air. From storage tank 30 the pretreated water is routed out of processing unit 2 through a transfer pipe 35 to dispenser 1 as shown schematically in FIG. 4. Transfer pipe 35 may carry all of the pretreated water directly to dispenser 1 or it may have multiple outlets. For instance, in some supermarket applications, the pretreated water would be used to mist the produce racks to help keep refrigerated vegetables moist.

Figure 1:
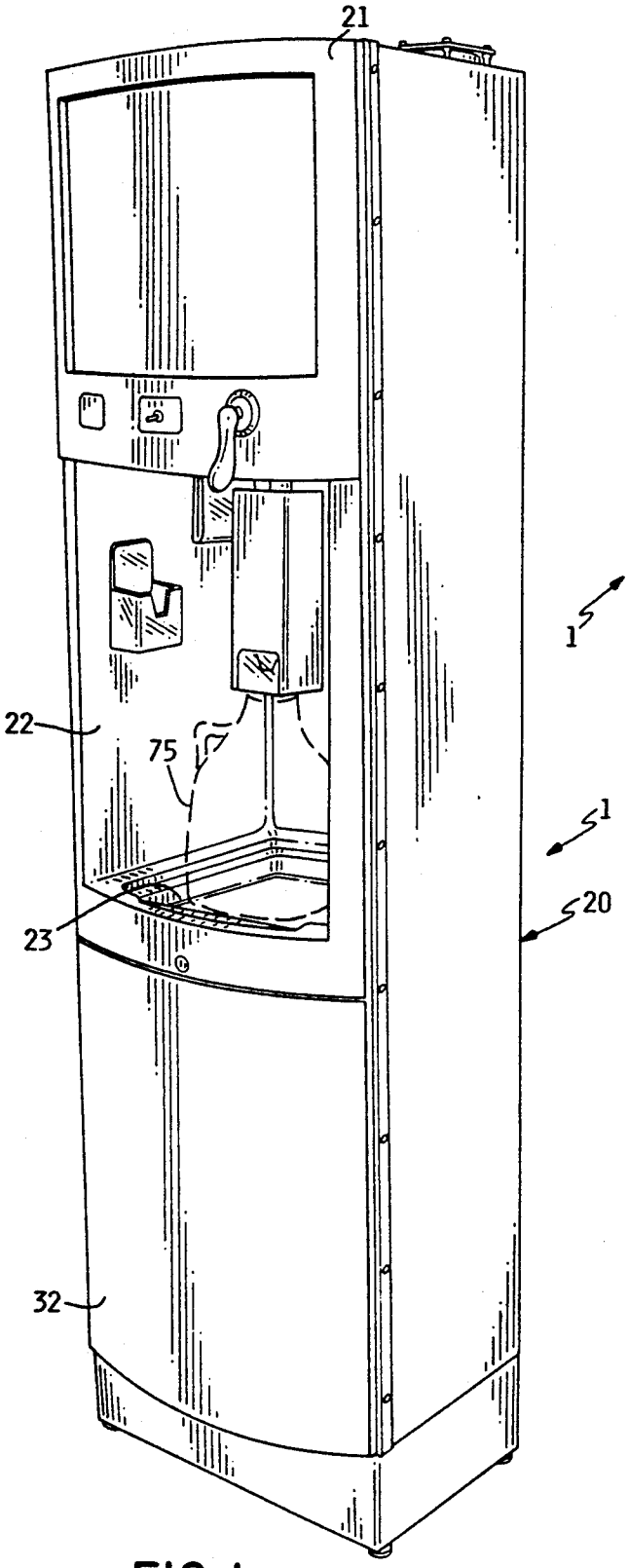
FIG. 1 is a perspective orthogonal view of a dispensing cabinet of the type which utilizes the present invention.
Figure 6:
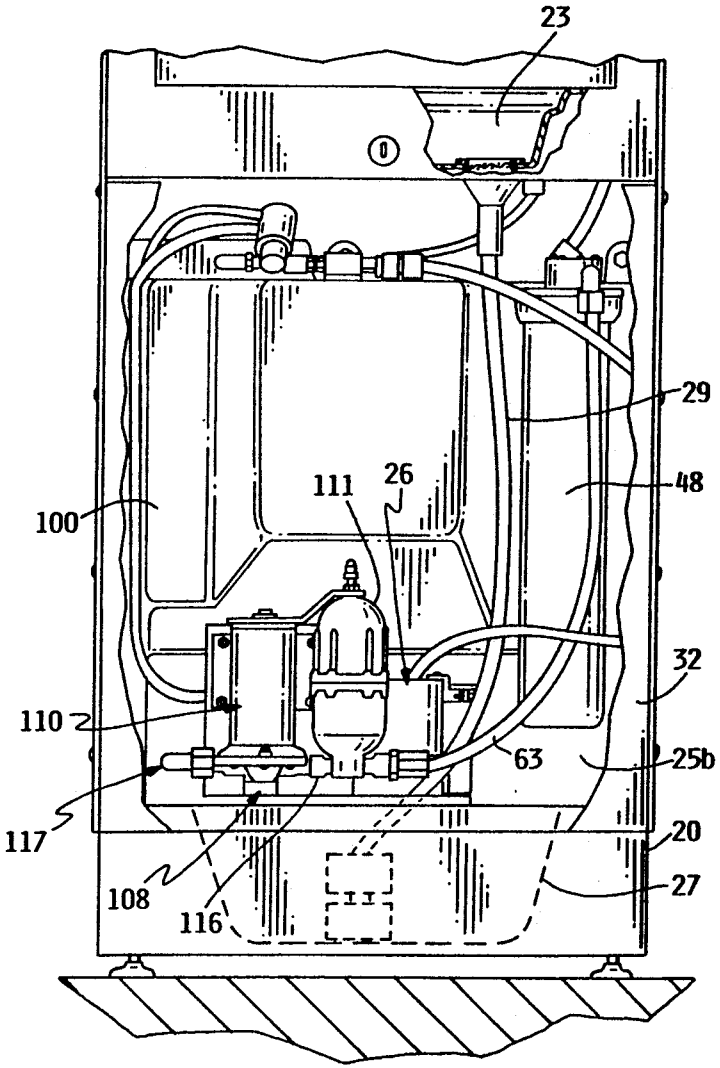
FIG. 6 is a front view of the bottom portion of the dispensing cabinet shown in FIG. 1 partially broken away to show components which may be used to practice the present invention.

The preferred embodiment of the present invention is incorporated in dispenser I shown in FIGS. 1 and 2. Thus a general description of it will be provided. Typically dispenser 1 will be located in a location apart from the location of processing unit 2. It is generally located in an area of the store where a customer can conveniently access it. Water from processing unit 2 is fed to dispenser 1 by means of any variety of FDA approved tubing or piping well known in the art. Dispenser I is comprised of a free standing cabinet 20 having an upwardly hinged top front panel 21 and a removable bottom front panel 32. Located behind panels 21 and 32 is an equipment bay having an upper portion **25*a* and a lower portion 25*b*. Front panel 21 is contoured to form a dispensing compartment 22 that is open on the side facing the front dispenser I. Dispensing compartment 22 is the area where the customer would place his or her jug for filling with purified water. A dispensing spout assembly 70, shown in FIG. 5 and as will be described in more detail subsequently, is located in the top of compartment 22 and a drain well 23 (shown in FIG. 1) is formed in the bottom for any overflow water. Drain well 23, as is shown in FIG. 6, connects to a drain pipe 29 which empties into a drain basin 27. A sump pump 26 pumps water out of drain basin 27 and out of cabinet 20** to a remote floor drain.

Figure 5:
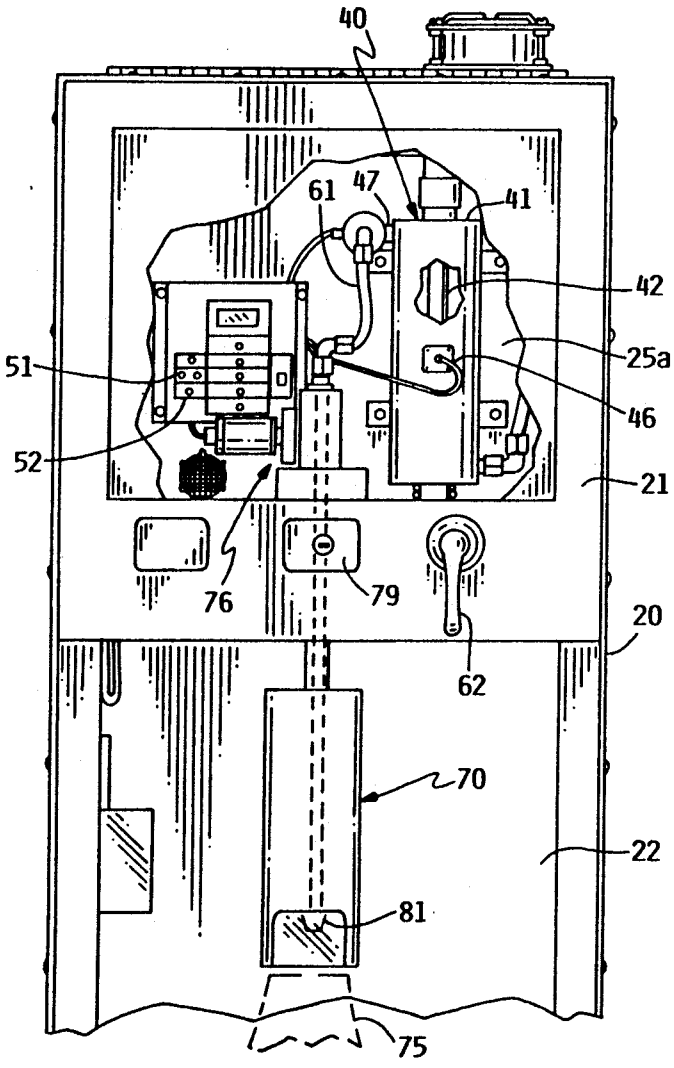
FIG. 5 is a front view of the top portion of the dispensing cabinet shown in FIG. 1 partially broken away to show components which may be used to practice the present invention.

Water entering cabinet 20 from processing unit 2 is stored in dispenser storage tank 100 shown in FIG. 6. When a customer desires to draw water, he or she activates control valve handle 62 to activate cabinet pump 110. Pump 110 pumps water through a line 116 shown in FIG. 6. Line 116 communicates with an accumulation tank 111 and also with line 63 which connects with filter 48. The function of accumulation tank 111 will be discussed in further detail subsequently. From filter 48 the water is routed through ultraviolet treating assembly 40, as shown in FIG. 5, at the approximate flow rate of 2.5 gallons per minute. Ultraviolet treating assembly 40 is intended to use ultraviolet light to irradiate the water supply passing by it to kill any bacteria or other susceptible microorganism that may be present in the water. Treating assembly 40 is comprised of a housing 41 through which water is pumped, and an ultraviolet lamp 42 positioned generally in the center of housing 41 such that the ultraviolet light it emits passes through the water in housing 41 to irradiate it, and past an ultraviolet light sensor 46 to be discussed in further detail later. After the water has been irradiated by lamp 42 it is routed through a discharge line 47 and on through line 61 to dispensing spout assembly 70.

A first element of the present invention is the provision of improved spout movement apparatus and method for using it. Both apparatus and method prevent the spout from causing injury or damage injuring persons or property. After water has been treated by ultraviolet treating lamp 40 it flows through conduit 61 to dispensing spout assembly 70. It is the purpose of dispensing spout assembly 70 to serve as spout means to direct the flow of purified water to the opening of a container placed below it in dispensing compartment 22. A jug or similar container, designated by the numeral 75 and shown in dotted lines in FIGS. 1 and 5, having a relatively small opening that can be sealed with a cap, is typical of the container used to remove water from dispenser 1. Because the height of jug 75 will vary from one dispenser customer to another, it has been known in the past to provide dispensing spout assembly 70 with height adjustment means 76, shown in FIGS. 5 and 7, for varying the spout height from an elevated position to a lowered position. Specifically, as is shown in detail in FIG. 7, and by placement in FIG. 5, height adjustment means 76 are comprised of a drive motor 72, being of the gear drive motor type, mounted above dispensing compartment 22. Drive motor 72 is geared down go a desirable RPM level to move spout assembly 70 by means of a commercially available gear box 126. In the preferred embodiment, drive motor 72 and gear box 126 are manufactured by ECM Motor Co. as part number 4482-1B1.

Figure 7:
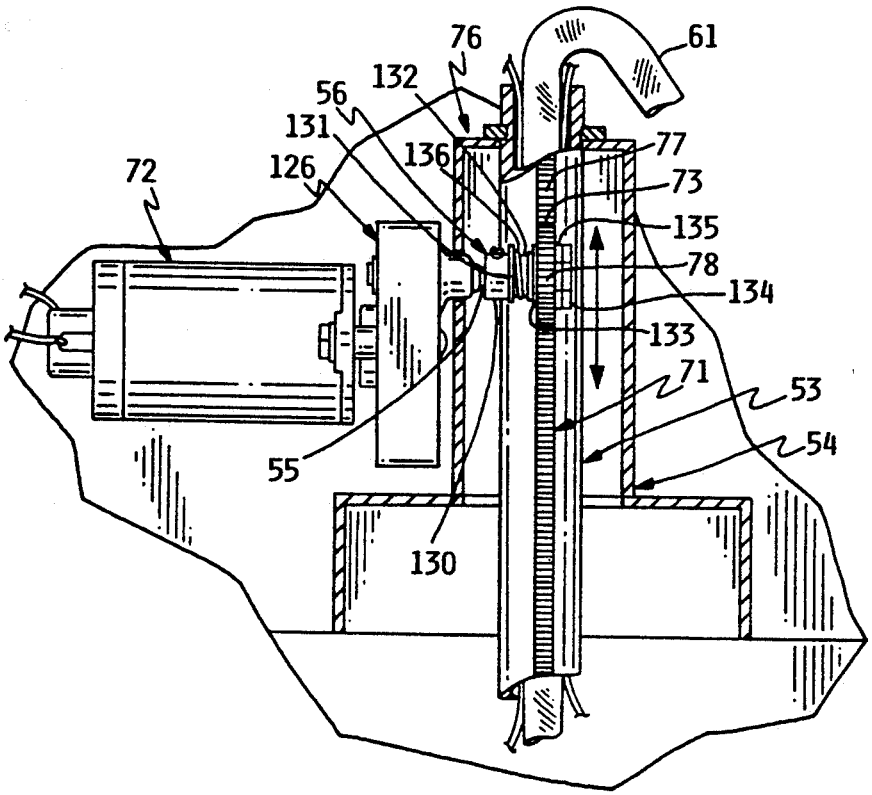
FIG. 7 is a partial sectional view of the dispensing spout drive mechanism showing the slip clutch mounted between the spout drive gear and the gear drive motor assembly.

A toothed gear rack 71 is affixed to the side of a moveable sleeve 53 through which runs water conduit 61, as shown in detail in FIG. 7. Moveable sleeve 53 is supported by support assembly 54 and extends downwardly to where it joins dispensing spout assembly 70 as shown in FIGS. 5 and 7. A toothed drive gear 73, operably connected to the drive shaft of drive motor 72, has gear teeth 78 (numbering 48 in the preferred embodiment) matched to the contour of teeth 77 in gear rack 71. Thus, rotation of drive motor 72 operably moves dispensing spout assembly 70 up and down. Drive motor 72 is driven in either direction by means of spout control switch 79 mounted on the front of cabinet 20 as shown in FIG. 5. By moving control switch 79 either up or down, the dispensing customer can move dispensing spout assembly 70 either up or down to position the dispensing nozzle 81 adjacent the top of jug 75.

To prevent the dispensing spout assembly 70 from pinching a customer's fingers slip clutch 56, customer's fingers between it and the top of jug 75 as the nozzle assembly 70 is moved downwardly, a slip clutch 56, shown in FIG. 7, is positioned between the output shaft 55 of gear box 126 and gear 73. Slip clutch 56 may be of any design well known in the art. In the preferred embodiment it is manufactured under brand name Stock Drive Products as part number: S9906A-MM4-04. In the preferred embodiment, and as is shown in FIG. 7, slip clutch 56 is comprised of a hub portion 130 which has an opening (not shown in the drawings) in which gear shaft 55 from reduction gear 126 is fixedly mounted using a set screw or other means well known in the art. Hub portion 130 joins a shoulder 131 which connects with a clutch shaft 132. Clutch shaft 132 extends through a central opening (not shown in the drawings) in gear 73 and has a threaded end to which are attached first and second locking nuts, 134 and 135, respectively. Clutch shaft 132 can rotate within the opening of gear 73. A coil compression spring 136 surrounds clutch shaft 132 bearing against shoulder 131 and a friction washer 133 which bears against the side surface of gear 73 on the slip clutch side. The compression force of spring 136 bears against friction washer 133 to exert torsional force on gear 73 to drive it in response to the power of drive motor 72. However, the drive force of clutch shaft 132 will be insufficient to rotate gear 73 if there is a retarding force on gear 73 and the compressive force of spring 136 is insufficient to overcome such retarding force. This would desirably occur if a customer's hand were caught between nozzle assembly 70 and a container positioned beneath it. To assure that this would occur, the compressive load exerted by spring 136, and the resulting rotational force imparted to gear 73, is set by varying the length of spring 136. This is done by advancing or retarding the position of locking nuts 134 and 135 on threaded clutch shaft 132. This setting allows the clutch 56 to "slip", and not drive gear 73 and spout assembly 70, at a force level equivalent to a hand being placed beneath the spout assembly. In the preferred embodiment with the previously identified slip clutch model the proper force has been achieved by tightening the locking nut until the spring is fully compressed and then loosening the nut 1/6th of one turn. The locking nut is then locked in place. In general, this force would be determined, and the proper slip clutch 56 selected, by knowing the drive force of the drive motor 72 and reduction gear 126 being used. In any event the force at which the clutch slips would be that felt by a finger inserted between the jug 75 and assembly 70 where discomfort is felt by the hand or damage results to jug 75, whichever is less.

The method employed in the present invention include a method for limiting the downward force exerted by a spout which dispenses water into the open end of a container, The apparatus would include a spout and motor means for moving the spout from an elevated position to a lowered position where the spout would contact the container. In the method there is provided a clutch which is operably connected between the motor means and the spout such that the clutch limits downward force of the spout against the container. The apparatus and its operation in practicing this method is as described herein.

The flow of water out of nozzle 81 is controlled by means of dispensing control valve handle 62 and a valve assembly to which it is attached (not shown in the drawings) mounted to the front of cabinet 20 as shown in FIG. 5. Rotation of control handle 62 by the customer (90 degrees for full flow) provides a variable flow of water out of nozzle 81. Pretreated water received in dispenser 1 from processing unit 2 is stored in dispenser atmospheric storage tank 100 located in the bottom of dispenser cabinet 20 as shown in FIG. 6. The size of storage tank 100 may be selected at will, and in the preferred embodiment is 20 gallons. Water is drawn from storage tank 100 by means of dispensing pump 110. Any air entering tank 100 is filtered by means of an appropriate air filter. Dispensing pump 110 pumps the water through ultraviolet treating lamp 40 and ultimately through dispensing spout 70 and nozzle 81. Nozzle 81 contains an aerator to minimize splashing.

Figure 8:
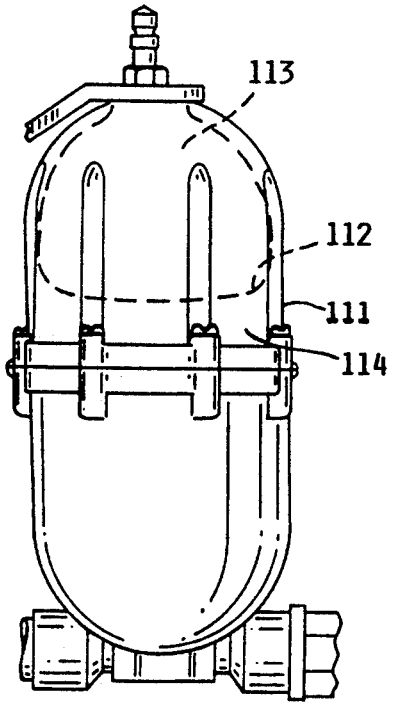
FIG. 8 is an exterior view of the accumulator tank showing the internal bladder by dotted lines when the bladder is partially inflated with air.

A further element of the present invention is the use of a variable capacity accumulator tank 111, shown in FIG. 8, positioned between storage tank 100 and nozzle 81 in cabinet 20 as is shown in FIG. 6. The use of an accumulation tank avoids the pump wear and tear and oscillating noise that has been experienced in earlier designs which results when control valve handle 62 is adjusted to "top off" jug 75. In this way harmful pressure spikes are limited, noise is minimized and pump overheating is reduced. Specifically, accumulation tank 111 stores a sufficient amount of water to top off the jug. Tank 111 is a pressurized bladder storage tank that is precharged. Thus, as control handle 62 is repeatedly adjusted, water in pressurized accumulation tank 111 is forced under its pressure out of nozzle 81 without the need for pump 110 to reactivate at short intervals of flow.

Accumulation tank 111 is connected with storage tank 100 by line 117 shown in FIG. 6. Water is pumped by pump 110 through line 116 shown in FIG. 6. Thus, pump 110, when activated, pumps water from storage tank 100 through line 116 to either charge accumulation tank 111 with a water fill or into line 63 and on to filter 48, which is a carbon polishing filter intended to remove color, taste and odor from the water. From filter 48 the water flows into the ultraviolet treating area and then out dispensing nozzle 81. As is shown in FIG. 8, accumulation tank 111 is a precharged bladder type tank having a flexible internal bladder 112. Bladder 112 provides an air chamber 113 and a liquid chamber 114, as shown in FIG. 8. Air chamber 113 is precharged to approximately 20 psi. As water is removed from accumulation tank 111, this pressure in the bladder drops. When the control valve handle 62 is turned on and the pressure drops from 40 psi to 20 psi, a pressure switch 108, integral to pump 110 shown in FIG. 6, starts the pump. First tank 111 is depleted before pump 110 is activated to provide a continuous full flow of water until low flow adjustments are made. At this point, water will first be supplied out of accumulation tank 111. Should there be sufficient supply under pressure to top off the container 75, the pump 110 will not be started by its pressure switch. If such supply is insufficient, pump 110 will be started and water will be pumped through line 116 to recharge accumulation tank 111 with water and supply water through line 63. Since tank 111 is sealed, no air is allowed into contact with water in tank 111. In the preferred embodiment the accumulation tank 111 is ShurFlo brand, model No 181-200. Valving and water flow circuits, shown schematically in FIG. 4, and well known in the water pumping art, are utilized to route water from storage tank 100 ultimately to nozzle 81 through accumulation tank 111 and then through the water tubing circuit previously described.

The method employed in the present invention to provide water accumulation that prevents motor surges when a container is being topped off includes the provision of a primary storage tank for storing purified water to be dispensed. Also provided are a dispensing spout for dispensing the water, and a pump means for pumping the water from the storage tank to the dispensing spout through a valve that allows the flow of water to be controlled. The method includes the provision of an accumulator tank to accumulate the water, the accumulator tank being operably located between the pump means and the dispensing spout. The accumulator tank is adapted to receive and hold a quantity of the water and to release such quantity through the valve response to opening of the valve without the need for the pump means to be activated.

What is claimed is:

1. A purified water dispensing apparatus for self-service use by consumers, comprising:

a supporting frame;

a source of water;

a dispensing spout movably attached to said supporting frame by a rack mechanism to permit movement in a generally vertical direction relative to said supporting frame;

a delivery platform attached to said supporting frame in a generally horizontal disposition beneath said dispensing spout, for supporting containers having an aperture therein to receive purified water therethrough from said dispensing spout;

first means for raising and lowering said dispensing spout comprising drive gears engaging said rack mechanism;

second means for sensing a force that exceeds a predetermined magnitude acting against said dispensing spout in a direction generally opposed to movement thereof, and for stopping movement of said dispensing spout upon sensing such a force, comprising an adjustable slip clutch, operably connected to said drive gears, which may be adjusted to operate in response to force exceeding a predetermined magnitude;

an accumulator tank comprising a sealed chamber containing pressurized gas and also a flexible bladder, for receiving water through an intake port fluidly connected to said source of water, and for discharging water through an exit port;

third means, operably interposed between said source of water and said accumulator tank, for pumping water from said source to said dispensing spout and for purifying water from said source;

fourth means for measuring the pressure of gas within said sealed chamber of said accumulator tank;

fifth means for activating said pump means whenever the gas pressure within said accumulator tank reaches a value indicating that a predetermined amount of water is present within said accumulator tank.

2. A purified water dispensing apparatus as recited in claim 1, further comprising sixth means for controlling the flow of purified water to and through said dispensing spout, wherein said sixth means operates on said fluid connection between said accumulator tank and said dispensing spout.

3. A purified water dispensing apparatus as recited in claim 2, wherein said sixth, flow controlling, means comprises a flow valve.

4. A purified water dispensing apparatus as recited in claim 2, further comprising seventh means for more completely purifying water within said dispensing spout immediately before delivery into a container.

5. A purified water dispensing apparatus as recited in claim 4, wherein said seventh means for purifying water comprises an ultraviolet lamp.

6. A method for self-service dispensing of purified water into containers of various heights and dimensions, wherein purified water is delivered by an apparatus containing a movable dispensing spout fluidly connected with a source of purified water, means for moving said dispensing spout in a generally vertical direction above a delivery platform for holding a container on said apparatus, and means for delivering purified water from said source through said dispensing spout into an aperture in the surface of a container, when the aperture is positioned generally below said dispensing spout, said method comprising the steps of:

placing a container on said delivery platform;

positioning the container so that the aperture thereof is aligned approximately below said dispensing spout;

activating said means for moving said dispensing spout in a generally vertical direction in relation to the container, toward the aperture therein;

sensing an opposing force of predetermined magnitude acting upon said dispensing spout in a direction generally opposed to the motion of said dispensing spout;

automatically stopping the downward motion of said dispensing spout;

initiating said means for delivering purified water from said source of purified water through said dispensing spout and aperture into the container; and filling the container to the desired level.

7. A method for self-service dispensing of purified water as recited in claim 6, wherein said stopping step comprises disengagement, by means of a slip clutch, of drive gears operably connecting said movement means with said dispensing spout.

8. A method for self-service dispensing of purified water as recited in claim 7, wherein said sensing step comprises sensing contact between said dispensing spout and a surface of the container.

9. A method for self-service dispensing of purified water as recited in claim 8, wherein a feeler arm of said dispensing spout makes contact with a surface of the container at a location thereon generally adjacent to the aperture therein.

10. A method for self-service dispensing of purified step comprises filling the container by non-motorized means for dispensing small quantities of purified water from said source through said dispensing spout.

11. A method for self-service dispensing of purified water as recited in claim 10, wherein said filling step comprises delivering purified water from an accumulator tank fluidly interposed between said dispensing spout on one side and said source of purified water on the other side, said accumulator tank comprising a sealed chamber containing pressurized gas and a flexible bladder, said bladder receiving purified water through an intake port fluidly connected to said source of purified water, and discharging purified water through an exit port fluidly connected to said dispensing spout.

12. A method for self-service dispensing of purified water as recited in claim 11, further comprising a step of sensing the pressure within said accumulator tank.

13. A method as recited in claim 12, further comprising a step of automatically activating said pump whenever the pressure within said accumulator tank reaches a predetermined level indicating presence of a predetermined amount of purified water within said accumulator tank.

* * * * *